US007722393B1

(12) United States Patent
Huang et al.

(10) Patent No.: US 7,722,393 B1
(45) Date of Patent: May 25, 2010

(54) BATTERY CONNECTOR

(75) Inventors: Sheng-Yuan Huang, Tu-Cheng (TW); Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,904

(22) Filed: Dec. 1, 2008

(51) Int. Cl.
*H01R 13/73* (2006.01)

(52) U.S. Cl. ..... 439/571; 439/81; 29/877

(58) Field of Classification Search ..... 439/500, 439/862, 66, 83, 627, 571, 554, 547, 566, 439/567, 570, 81; 29/877
See application file for complete search history.

(56) References Cited

U.S. PATENT DOCUMENTS 4,907,987 A * 3/1990 Douty et al. ..... 439/571
5,080,611 A * 1/1992 Hypes ..... 439/567
5,259,769 A * 11/1993 Cruise et al. ..... 439/65
6,113,440 A * 9/2000 Fijten et al. ..... 439/862
6,244,875 B1 * 6/2001 McHugh et al. ..... 439/73
6,371,802 B1 * 4/2002 Smalley et al. ..... 439/567
6,851,986 B2 * 2/2005 Zhao ..... 439/744
6,875,049 B2 * 4/2005 Kyowski et al. ..... 439/500
6,991,472 B2 * 1/2006 Du et al. ..... 439/66
7,604,500 B1 * 10/2009 Chen ..... 439/570

* cited by examiner

*Primary Examiner*—Xuong M Chung-Trans
(74) *Attorney, Agent, or Firm*—Rosenberg, Klein & Lee

(57) ABSTRACT

A battery connector adapted for being electrically connected with a printed circuit board includes an insulating housing defining a plurality of terminal passageways, a plurality of fixing members fastened in the insulating housing and stretching beyond a top surface of the insulating housing for being soldered to the printed circuit board, and a plurality of electrical terminals disposed in the corresponding terminal passageways and each having a fixing board, a first contact portion stretching out of a bottom surface of the insulating housing and a substantially lying-V shaped second elastic portion extended from a top of the fixing board. A free end of the second elastic portion stretches out of the top surface of the insulating housing and is arched upward to form a second contact portion capable of elastically abutting against the printed circuit board.

10 Claims, 3 Drawing Sheets

BATTERY CONNECTOR

BACKGROUND OF THE INVENTION

1. Field of the Invention

The present invention generally relates to a battery connector, and more particularly to a battery connector capable of making terminals and a printed circuit board electrically connected with each other steadily.

2. The Related Art

It is well known that mobile phones or other portable electronic devices often use rechargeable batteries as power sources. Traditionally, the mobile phone and the electronic device need a battery connector mounted therein for electrically connecting the rechargeable battery with a printed circuit board mounted in the mobile phone and the electronic device. The battery connector is connected with the printed circuit board by soldering terminals thereof to the printed circuit board by means of a SMT method. However, when the terminals are not coplanar due to the inaccurate manufacturing, some terminals near the printed circuit board are easily soldered to the printed circuit board while other terminals apart from the printed circuit board are difficultly soldered to the printed circuit board. It results in a bad electrical connection between the terminals and the printed circuit board. Thus a battery connector which can make the terminals and the printed circuit board electrically connected with each other steadily is required.

SUMMARY OF THE INVENTION

An object of the present invention is to provide a battery connector adapted for being electrically connected with a printed circuit board. The battery connector includes an insulating housing defining a plurality of terminal passageways passing through a top surface and a bottom surface thereof and extending longitudinally, a plurality of fixing members fastened in the insulating housing and stretching beyond the top surface of the insulating housing for being soldered to the printed circuit board, and a plurality of electrical terminals disposed in the corresponding terminal passageways. Each of the electrical terminals has a fixing board disposed vertically, a first contact portion stretching out of the bottom surface of the insulating housing, and a substantially lying-V shaped second elastic portion extended from a top of the fixing board. A free end of the second elastic portion stretches out of the top surface of the insulating housing and is arched upward to form a second contact portion capable of elastically abutting against the printed circuit board.

As described above, the battery connector and the printed circuit board are electrically connected with each other by way of the second contact portions of the electrical terminals elastically abutting against the printed circuit board because of the elasticity of the second elastic portions in order to ensure a steady electrical connection between the battery connector and the printed circuit board even if the second contact portions are not coplanar due to the inaccurate manufacturing.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
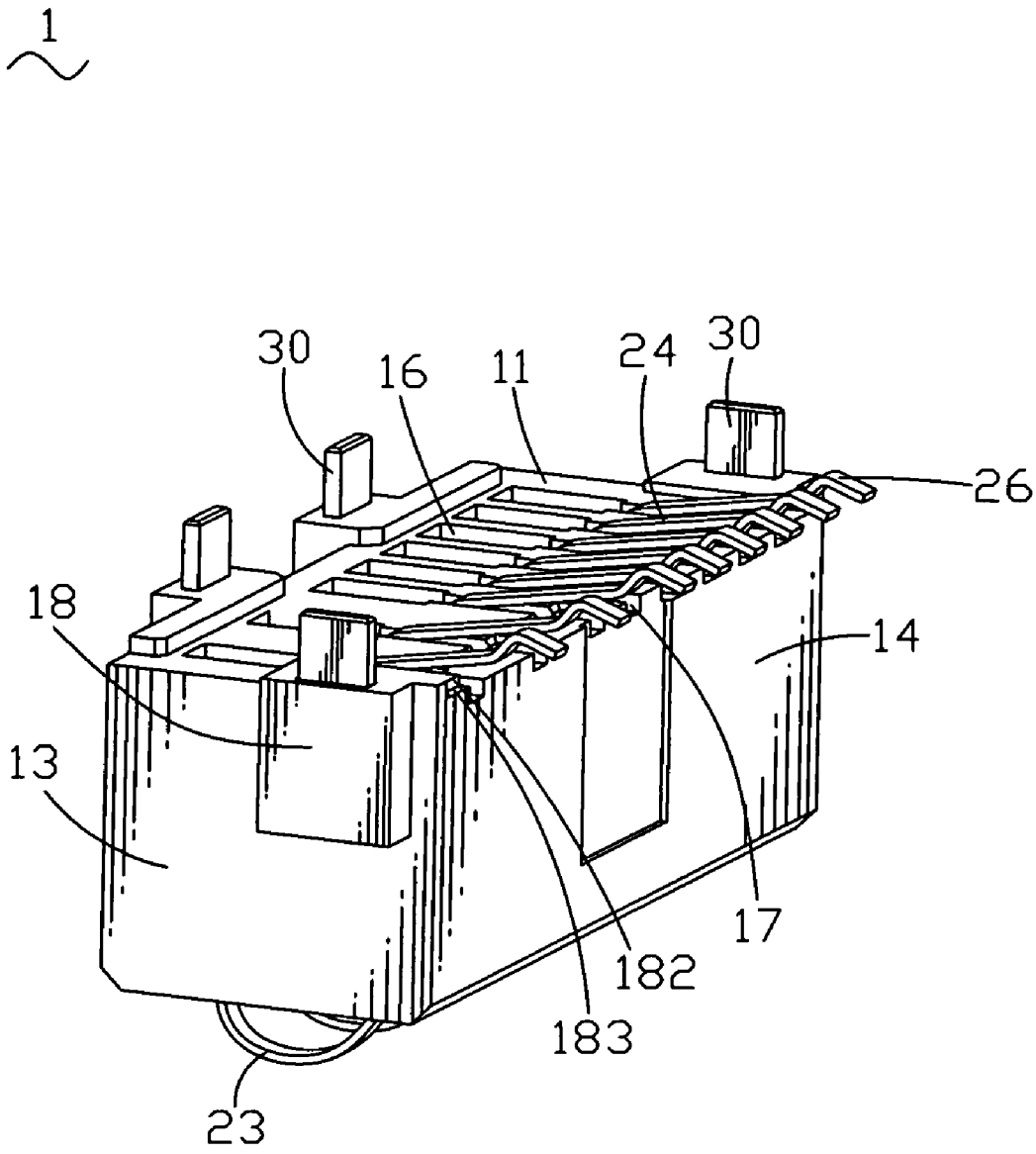
FIG. 1 is a perspective view of a battery connector in accordance with the present invention.
Figure 2:
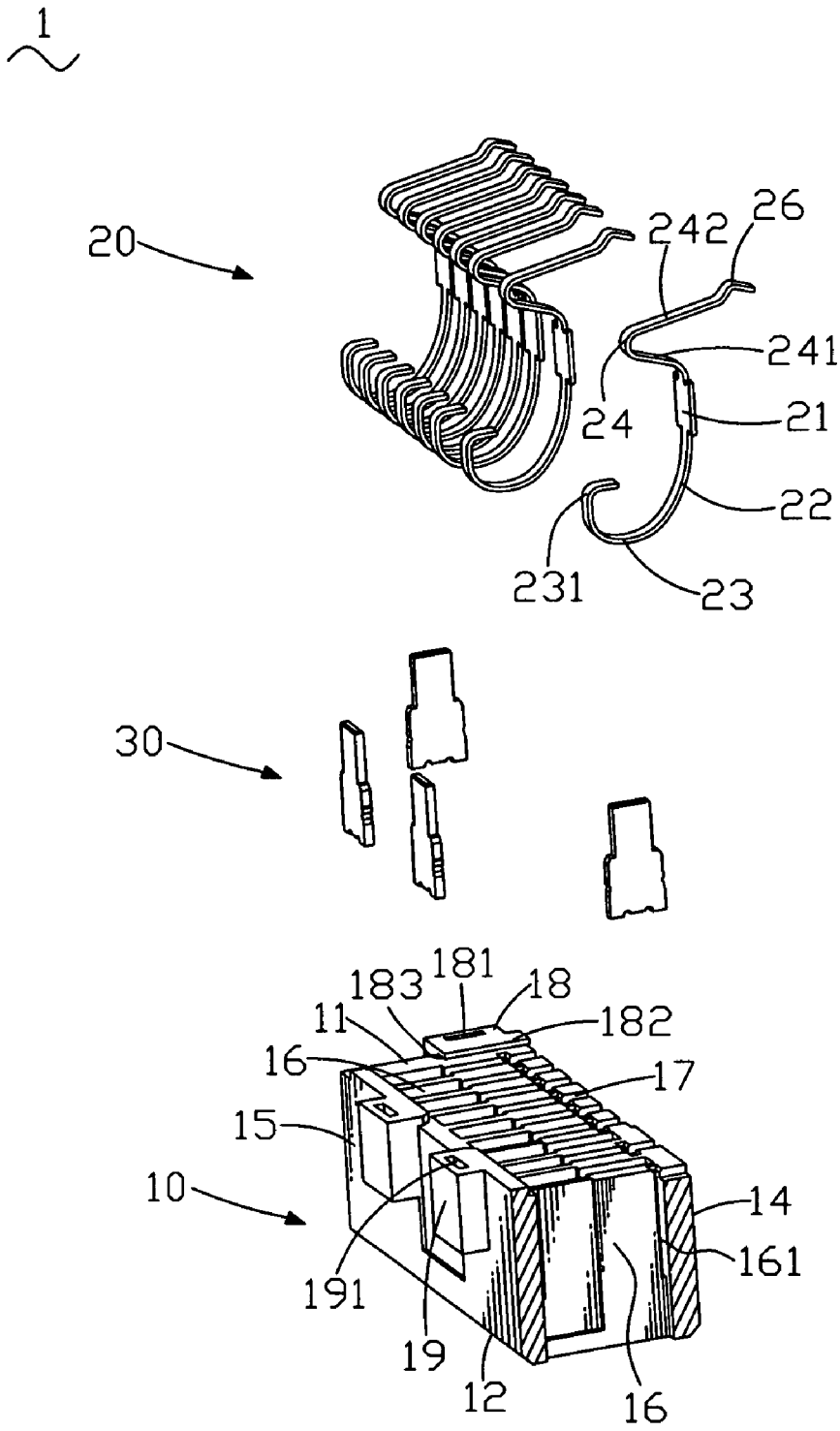
FIG. 2 is an exploded view of the battery connector of FIG. 1, wherein an insulating housing of the battery connector is cut open in part.
Figure 3:
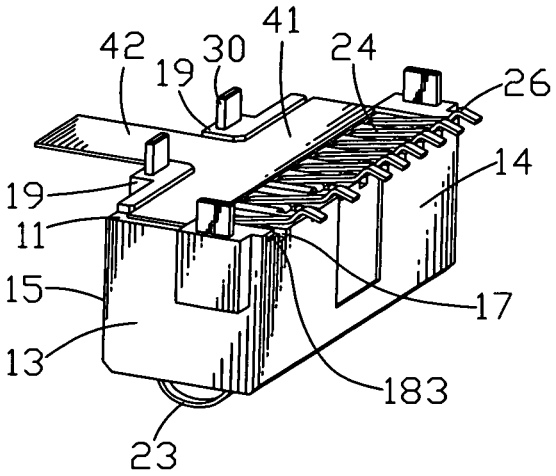
FIG. 3 is a perspective view showing a preloading board disposed on the battery connector.
Figure 4:
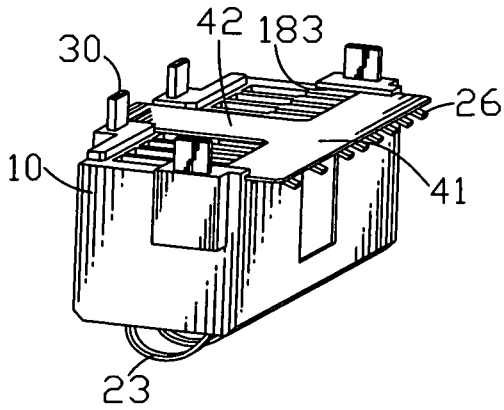
FIG. 4 is another perspective view showing the preloading board disposed on the battery connector.
Figure 5:
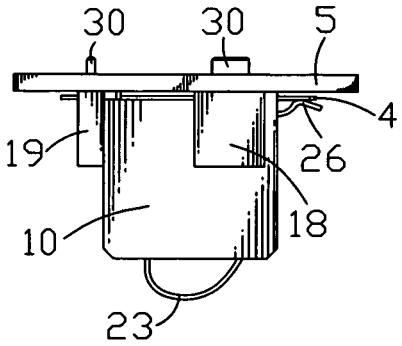
FIG. 5 is a lateral view showing a printed circuit board assembled on the battery connector, wherein the preloading board is disposed on the battery connector.
Figure 6:
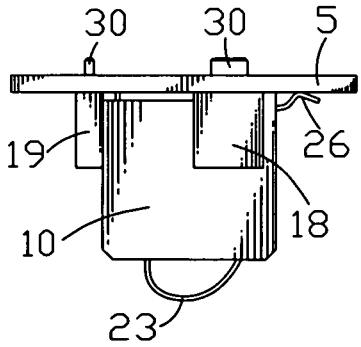
FIG. 6 is a lateral view showing the printed circuit board assembled on the battery connector, wherein the preloading board is withdrawn from the battery connector.

With reference to FIG. 1 and FIG. 2, a battery connector 1 of the present invention includes an insulating housing 10, a plurality of electrical terminals 20 and four fixing members 30 received in the insulating housing 10 respectively.

The insulating housing 10 is of rectangular shape and has a top surface 11, a bottom surface 12, two side surfaces 13, a front surface 14 and a rear surface 15. A middle of the insulating housing 10 defines a plurality of substantially rectangular terminal passageways 16 arranged at regular intervals along a transverse direction thereof and each vertically passing through the top surface 11 and the bottom surface 12. A front of each terminal passageway 16 extends toward two sides to form a pair of fixing fillisters 161. A top front of each of the terminal passageways 16 extends forward to penetrate through the front surface 14 and the top surface 11 to form a locating cavity 17. A top of each side surface 13 protrudes outward to form a rectangular first fixing block 18 adjacent to the front surface 14 and extending beyond the top surface 11. Each of the first fixing blocks 18 defines a first fixing aperture 181 vertically passing therethrough. Two top ends of the first fixing blocks 18 extend face-to-face to form a pair of preventing boards 182 spaced away from the top surface 11. Accordingly, a pair of guiding channels 183 is formed between the corresponding preventing boards 182 and the top surface 11. A top of the rear surface 15 protrudes rearward to form two rectangular second fixing blocks 19 extending beyond the top surface 11 and apart from each other. Each of the second fixing blocks 19 defines a second fixing aperture 191 vertically passing therethrough.

Referring to FIG. 2 again, each of the electrical terminals 20 has a rectangular fixing board 21 disposed vertically. A bottom middle of the fixing board 21 extends downward and is bent rearward to form a first elastic portion 22. A free end of the first elastic portion 22 extends rearward to form a first contact portion 23. A free end of the first contact portion 23 is bent upward and then forward to form a fastening portion 231. A substantially lying-V shaped second elastic portion 24 is extended from a top middle of the fixing board 21. The second elastic portion 24 has a lower arm 241 extended rearward and inclined upward from the top middle of the fixing board 21, and an upper arm 242 extended forward and inclined upward from a free end of the lower arm 241. A free end of the second elastic portion 24 stretches beyond a front of the fixing board 21 and is arched upward to form a second contact portion 26.

Referring to FIG. 1 again, in assembly, the fixing board 21, the elastic portions 22, 24 and the fastening portion 231 of the electrical terminal 20 are received in the corresponding terminal passageway 16 of the insulating housing 10. Two sides of the fixing board 21 are buckled into the corresponding fixing Misters 161. The first contact portion 23 stretches out of the bottom surface 12. The free end of the second elastic portion 24 stretches out of the top surface 11 and is located above the corresponding locating cavity 17. The second contact portion 26 is located in front of the front surface 14 and higher than the first fixing blocks 18. The fixing members 30 are fastened in the fixing apertures 181, 191 of the corresponding fixing blocks 18, 19 and a top end of each fixing member 30 stretches out of a top of the corresponding fixing block 18, 19.

Referring to FIGS. 3-6, a T-shaped preloading board 4 which has a pressing board 41 extending transversely and a driving board 42 extending rearward from a rear middle of the pressing board 41 is movably disposed on the battery connector 1 before the battery connector 1 is assembled to a printed circuit board 5, wherein the pressing board 41 is movably disposed on a rear of the top surface 11 of the insulating housing 10 and the driving board 42 is movably located between the second fixing blocks 19. Then the driving board 42 is pushed forward to make the pressing board 41 slide forward along the guiding channels 183 so as to press the second contact portions 26 downward and make the free end of the corresponding second elastic portions 24 received in the corresponding locating cavities 17. At this moment, the top ends of the fixing members 30 pass through the printed circuit board 5 and are further soldered to the printed circuit board 5 so as to secure the battery connector 1 to the printed circuit board 5 firmly. At last, the driving board 42 is further pushed forward so as to make the preloading board 4 withdrawn from a front of the battery connector 1. After the preloading board 4 being withdrawn from the battery connector 1, the second contact portions 26 of the electrical terminals 20 abut against a bottom of the printed circuit board 5 because of elasticity of the second elastic portions 24 that ensures an electrical connection between the battery connector 1 and the printed circuit board 5.

As described above, the battery connector 1 and the printed circuit board 5 are electrically connected with each other by way of the second contact portions 26 of the electrical terminals 20 elastically abutting against the bottom of the printed circuit board 5 because of the elasticity of the second elastic portions 24 in order to ensure a steady electrical connection between the battery connector 1 and the printed circuit board 5 even if the second contact portions 26 are not coplanar due to the inaccurate manufacturing.

What is claimed is:

1. A battery connector adapted for being electrically connected with a printed circuit board, comprising:

an insulating housing defining a plurality of terminal passageways passing through a top surface and a bottom surface thereof and extending longitudinally;

a plurality of fixing members fastened in the insulating housing and stretching beyond the top surface of the insulating housing for being soldered to the printed circuit board; and a plurality of electrical terminals disposed in the corresponding terminal passageways, each of the electrical terminals having a fixing board disposed vertically, a first contact portion stretching out of the bottom surface of the insulating housing, and a substantially lying-V shaped second elastic portion extended from a top of the fixing board, a free end of the second elastic portion stretching out of the top surface of the insulating housing and being arched upward to form a second contact portion capable of elastically abutting against the printed circuit board, the insulating housing having two side surfaces and a rear surface, a top front of each side surface protruding outward to form a first fixing block, a top of the rear surface protruding rearward to form two second fixing blocks apart from each other, each of the first and second fixing blocks defining a fixing aperture for fastening the corresponding fixing member therein, the first and second fixing blocks extend beyond the top surface of the insulating housing, two top ends of the first fixing blocks further extend face-to-face to form a pair of preventing boards, two guiding channels are accordingly formed between the preventing boards and the top surface, the battery connector further comprises a T-shaped preloading board movably disposed on the top surface of the insulating housing and further between the second fixing blocks.

2. The battery connector as claimed in claim 1, wherein a top of each terminal passageway extends forward and penetrates through a front surface of the insulating housing to form a locating cavity for receiving the free end of the corresponding second elastic portion therein, the second contact portion stretches out of the front surface of the insulating housing.

3. The battery connector as claimed in claim 1, wherein a bottom of the fixing board extends downward and is bent rearward to form a first elastic portion, the first contact portion is formed by a free end of the first elastic portion extending rearward, a free end of the first contact portion is bent upward and then forward to form a fastening portion, the first elastic portion and the fastening portion are received in the corresponding terminal passageway.

4. The battery connector as claimed in claim 1, wherein a front of each terminal passageway extends toward two sides to form a pair of fixing fillisters at a top thereof, two sides of the fixing board are buckled into the corresponding fixing fillisters.

5. The battery connector as claimed in claim 1, wherein the preloading board can move along the guiding channels forward to press the second contact portions downward before the fixing members are soldered to the printed circuit board, the preloading board can be withdrawn from a front of the insulating housing to make the second contact portions abut against the printed circuit board after the fixing members are soldered to the printed circuit board.

6. A battery connector adapted for being electrically connected with a printed circuit board, comprising:

an insulating housing defining a plurality of terminal passageways passing through a top surface and a bottom surface thereof and extending longitudinally, the insulating housing having two side surfaces and a rear surface, a top front of each side surface protruding outward to form a first fixing block, a top of the rear surface protruding rearward to form two second fixing blocks apart from each other, the first and second fixing blocks extend beyond the top surface of the insulating housing, two top ends of the first fixing blocks further extend face-to-face to form a pair of preventing boards, two guiding channels are accordingly formed between the preventing boards and the top surface;

a plurality of fixing members fastened in the insulating housing and stretching beyond the top surface of the insulating housing for being soldered to the printed circuit board; and a plurality of electrical terminals disposed in the corresponding terminal passageways, each of the electrical terminals having a fixing board disposed vertically, a first contact portion stretching out of the bottom surface of the insulating housing, and a substantially lying-V shaped second elastic portion extended from a top of the fixing board, a free end of the second elastic portion stretching out of the top surface of the insulating housing and being arched upward to form a second contact portion, wherein a preloading board is slidably disposed along the two guiding channels on the top surface of the insulating housing to press the second contact portions downward before the fixing members are soldered to the printed circuit board responsive to the preloading board being slid forward, and the preloading board is withdrawn from the insulating housing to make the second contact portions elastically abut against the printed circuit board after the fixing members are soldered to the printed circuit board.

7. The battery connector as claimed in claim 6, wherein a top of each terminal passageway extends forward and penetrates through a front surface of the insulating housing to form a locating cavity for receiving the free end of the corresponding second elastic portion therein, the second contact portion stretches out of the front surface of the insulating housing.

8. The battery connector as claimed in claim 6, wherein a bottom of the fixing board extends downward and is bent rearward to form a first elastic portion, the first contact portion is formed by a free end of the first elastic portion extending rearward, a free end of the first contact portion is bent upward and then forward to form a fastening portion, the first elastic portion and the fastening portion are received in the corresponding terminal passageway.

9. The battery connector as claimed in claim 6, wherein a front of each terminal passageway extends toward two sides to form a pair of fixing fillisters at a top thereof, two sides of the fixing board are buckled into the corresponding fixing fillisters.

10. The battery connector as claimed in claim 6, wherein each of the first and second fixing blocks defines a fixing aperture for fastening the corresponding fixing member therein.

* * * * *